US006206072B1

(12) United States Patent
Orihara et al.

(10) Patent No.: US 6,206,072 B1
(45) Date of Patent: Mar. 27, 2001

(54) FILM-TRANSFERRING DEVICE

(75) Inventors: Hiroshi Orihara, Kasukabe; Katsuaki Takahashi, Tokyo, both of (JP)

(73) Assignee: Plus Corporation, Tokyo (JP)

( * ) Notice: Subject to any disclaimer, the term of this patent is extended or adjusted under 35 U.S.C. 154(b) by 0 days.

(21) Appl. No.: 09/329,529

(22) Filed: Jun. 10, 1999

(30) Foreign Application Priority Data

Jun. 24, 1998 (JP) ..... 10-177602
Nov. 26, 1998 (JP) ..... 10-335758

(51) Int. Cl.[7] ..... B32B 31/00

(52) U.S. Cl. ..... 156/540; 156/577; 156/579; 242/588.6

(58) Field of Search ..... 156/238, 523, 156/527, 540, 574, 577, 579; 225/46; 118/76, 200, 257; 242/160.2, 160.4, 170, 171, 588, 588.2, 588.3, 588.6

(56) References Cited

U.S. PATENT DOCUMENTS 5,346,580 * 9/1994 Elges et al. ..... 156/540
5,897,742 * 4/1999 Semmler ..... 156/577
6,000,455 * 12/1999 Semmler ..... 156/540

FOREIGN PATENT DOCUMENTS 9-2724 1/1997 (JP) .

* cited by examiner

*Primary Examiner*—Mark A. Osele
(74) *Attorney, Agent, or Firm*—Darby & Darby

(57) ABSTRACT

A hand held film-transferring device for transferring a film made of correction agent, fluorescent agent, or a similar film onto a surface, such as a sheet of paper. In the disclosed invention a film-transferring tape can be kept as a spare without requiring the feed reel and the take-up reel to be integrally united into a fixed set of reels as in the conventional devices, thereby reducing necessary materials and making it easy to store and carry the film-transferring tape. The improvement includes a peg attached to the leading end of the film-transferring tape and the take-up reel. The film-transferring head can be put into a position ready for film transfer by rotating the film-transferring head only 360°, thereby facilitating exchange of the film-transferring tapes.

4 Claims, 3 Drawing Sheets

FILM-TRANSFERRING DEVICE

FIELD OF THE INVENTION

This invention relates to a film-transferring device which is used for transferring a film made of correction agent, fluorescent agent or the like and applied to a film-transferring tape, onto a surface (of a sheet of paper, or the like) to receive that film.

DESCRIPTION OF THE RELATED ART

There is publicly known a film-transferring device as disclosed in Japanese Patent Application Laid-Open No. 9-2724. This conventional film-transferring device houses, in a case, a feed reel and a take-up reel rotating together through a power-transmission means, wherein a film-transferring tape is fed by the feed reel; the tape is, while being moved, pressed against a film-receiving sheet by a film-transferring head projecting outside the case; and the used portion of the tape is wound around the take-up reel. With this publicly known device, the feed reel and the take-up reel are integrally united through a film-transferring tape wound around the feed reel, and these reels are detachably mounted on their respective axes.

SUMMARY OF THE INVENTION

The publicly known device is composed as described above, and thus a film-transferring tape to be prepared as a spare needs to be kept in such a manner that the feed and take-up reels are integrally united through the film-transferring tape. Thus, a unit of the members for storage becomes bulky, which causes a cumbersome process for storage. Furthermore, when the tape is used up, the whole of these reels must be discarded. This is, in fact, wasteful and uneconomical.

The present invention has been made in order to eliminate the above-described defects inherent to the conventional device by improving its structure. More particularly, the present invention is formed such that a film-transferring tape as a spare can be kept without requiring the feed reel and the take-up reel to be integrally united into a fixed set of reels as in the conventional device, thereby reducing necessary materials, and making it easy to store and carry the film-transferring tape. In another aspect, the present invention provides a film-transferring device, wherein once a peg is joined to the take-up reel and the film-transferring tape is stretched tautly between the feed and take-up reels, it is possible to easily put the film-transferring head into a position ready for transference of the film only by rotating the film-transferring head 360°, thereby facilitating exchange of the film-transferring tapes.

DETAILED DESCRIPTION OF THE PREFERRED EMBODIMENTS

Figure 1:
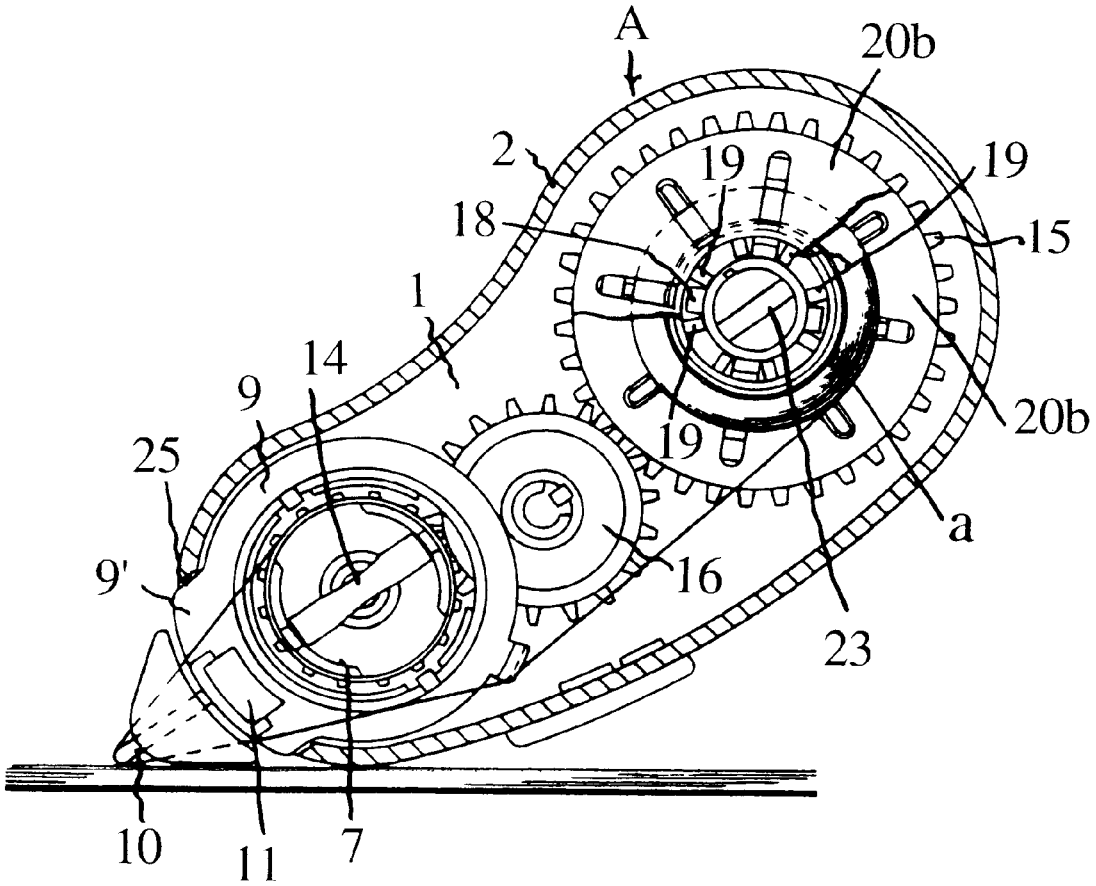
FIG. 1 is a front view of the device according to the present invention during use wherein some parts are removed for illustration.
Figure 2:
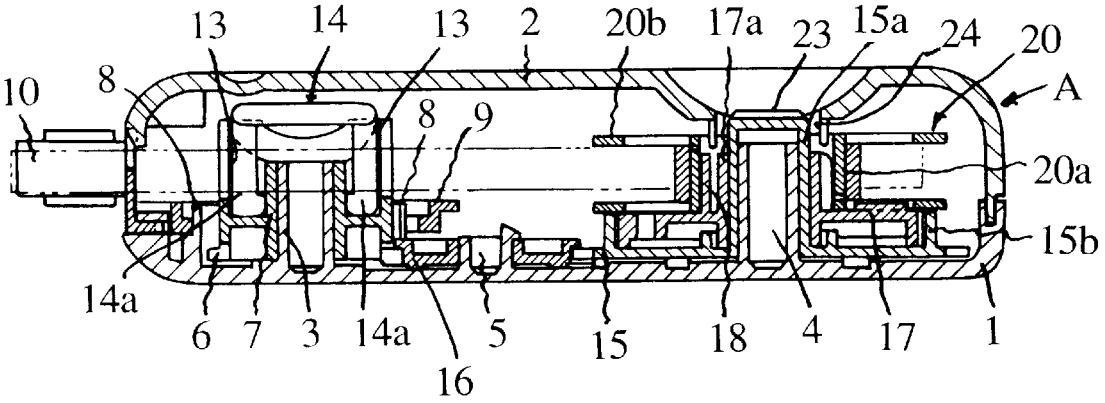
FIG. 2 is a sectional view of the device.

The present invention will be described below with reference to the embodiments illustrated in the accompanying drawings.

In the Figures, numeral 1 represents a base cover which constitutes a case A in collaboration with a lid cover 2; on the base cover 1 stand first and second support axes 3 and 4 both cylindrical, and stands a third support axis 5 similarly cylindrical between the support axes 3 and 4; rotatably mounted on the first support axis 3 is a take-up reel 7 which also functions as a boss of a dependent gear 6; around the periphery of the take-up reel 7, a plurality of arc-shaped guide strips 8, 8 and 8 project from the base cover 1 in manner that the guide strips are arranged concentrically with and partly surround the first support axis 3 and the take-up reel 7; mounted around the guide strips 8, 8 and 8 is a virtually ring-shaped rotatory disc 9 which rotatably engages with said strips; and from one end of the rotatory disc 9 projects a film-transferring head 10.

Figure 3:
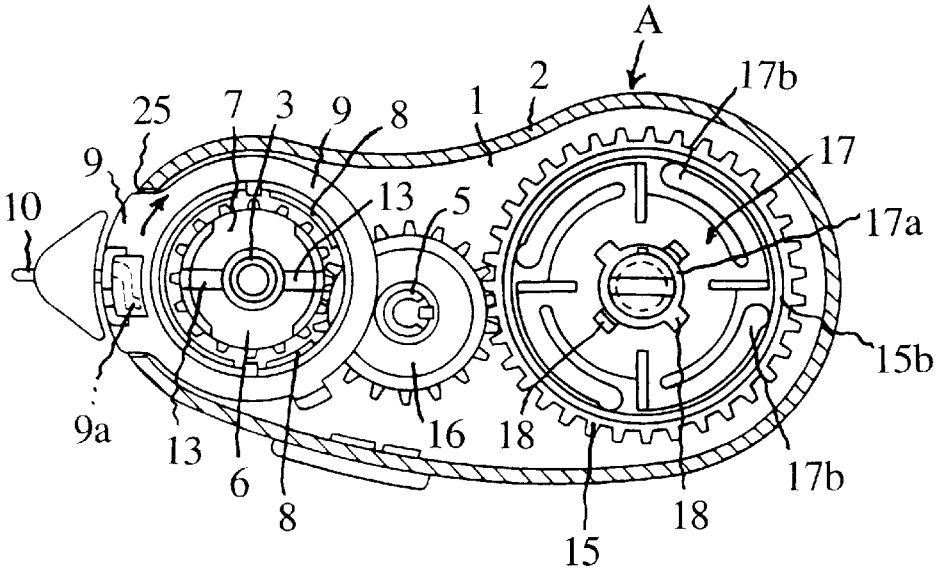
FIG. 3 is a front view of the device before it incorporates a feed reel wherein some parts are removed for illustration.
Figure 4:
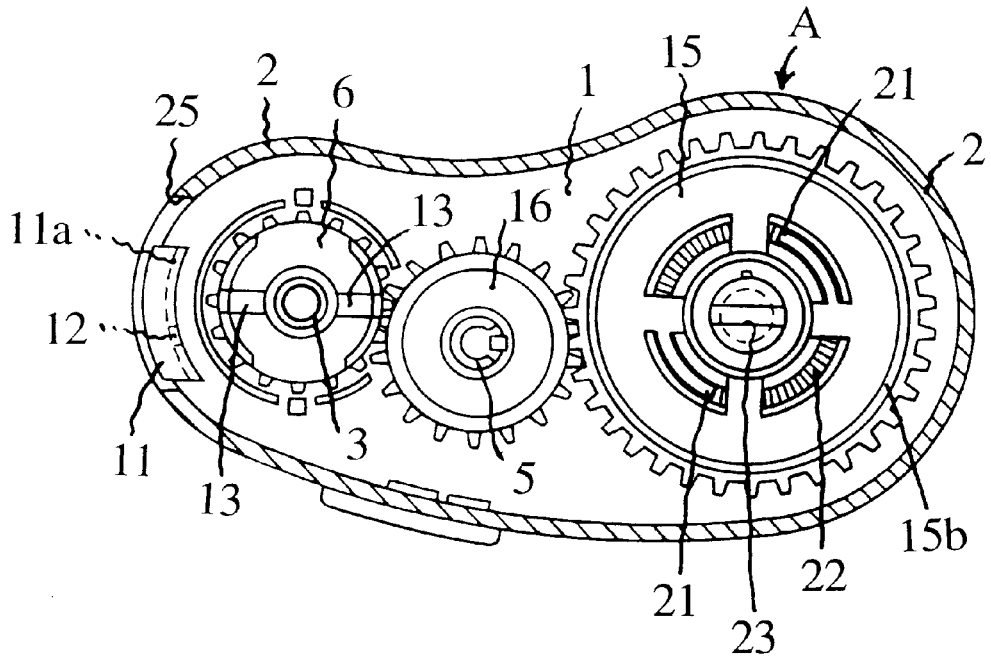
FIG. 4 is a front view of the device wherein a rotatory disc and a core member are removed for illustration.
Figure 5:
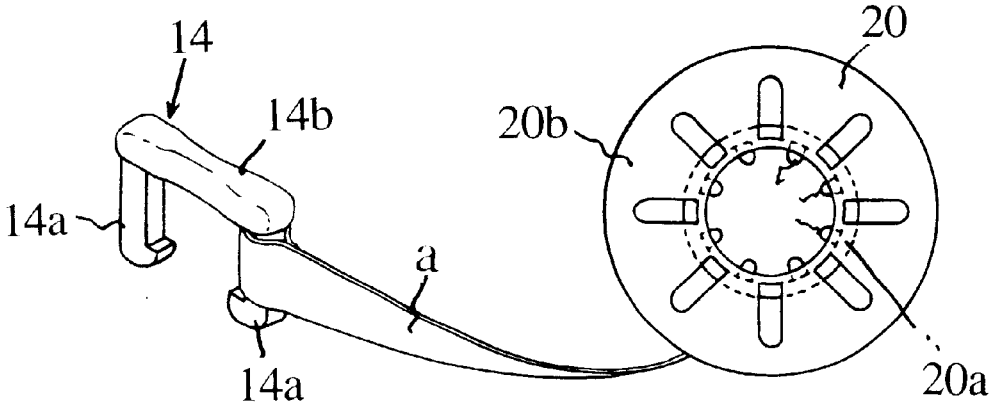
FIG. 5 is a perspective view of a film-transferring tape.

The rotatory disc 9 is further provided with a click stopper 9*a*; the stopper 9*a* engages with a hole 12 formed in the upright portion 11*a* of a brace 11 having a virtually L-shaped cross-section and projecting from the base cover 1 in the same direction as the first supportive axis 3, such that the stopper 9*a* works only when the rotatory disc 9 is pushed to rotate in the opposite direction of used portion of the film-transferring tape being collected by the take-up reel, that is, the disc 9 rotates 360° only in the direction as indicated by the arrow in FIG. 3.

During film-transferring operation (when the base cover 1 and the lid cover 2 are joined together to form the case A), a tab 9' of the rotatory disc 9 extending towards a film-transferring head 10 engages with a notch 25 formed at the frontal portion of the lid cover 2, and rotation of the disc 9 is restricted whether clockwise or counterclockwise.

However, when the lid cover 2 is detached from the base cover 1 (generally for charging a new film-transferring tape a), the restriction imposed by the lid cover 2 is released, and the rotatory disc 9 can rotate 360° only in such a direction (clockwise direction in FIG. 3) as to allow the take-up reel 7 to collect used portion of the film-transferring tape a.

On the end face of the take-up reel 7 in its axial direction, a pair of receptive cavities 13 and 13 are formed in opposed positions with respect to the first support axis 3 as the center; and fitted into those receptive cavities are two legs 14*a* and 14*a* of a two-legged peg 14 connected (attached) to the leading edge of a film-transferring tape a such that the peg 14 is detachably jointed to the take-up reel 7.

Rotatably mounted on the third support axis 5 is an intermediate gear 16 meshing with both the dependent gear 6 mounted on the first support axis 3 and a driving gear 15 mounted on the second support axis 4.

The driving gear 15 is rotatably mounted on the second support axis 4 through a boss portion 15*a*, and has an external annular cylinder 15*b* provided concentrically with the boss 15*a* in manner that the external annular cylinder 15*b* surrounds the boss 15*a*.

On the periphery of the boss 15*a*, rotatably mounted is a core member 17 which fits between the external annular cylinder 15*b* and the boss 15*a*. The core member 17 comprises a core cylinder 17a and springy pressing contacts 17*b*,17*b*, 17*b* and 17*b* projecting from the circumference of the core cylinder 17*a*.

The core member 17, because of the springy pressing contacts 17*b* pressing the inner circumference of the external annular cylinder 15*b* of the driving gear 15, is rotated by a rotatory force transmitted from the driving gear 15. From the periphery of a core cylinder 17*a* project receptive members 18 - - - , and a series of stopper studs 19 - - - to engage with the receptive members 18 - - - are arranged on the inner circumference of a feed reel 20.

The feed reel 20 comprises a main cylindrical body 20*a* and a pair of flange members 20*b*, 20*b* attached to one and the other sides of the main cylindrical body 20*a* respectively. A film-transferring tape a is wound around the main cylindrical body 20*a*. Inside the cylindrical body 20*a*, stopper studs 19 - - - are provided as described above. The leading edge of the film-transferring tape a is joined to one of two legs 14*a*, 14*a* of a peg 14 comprising a middle portion 14*b* and a pair of leg portions 14*a*, 14*a* provided on one and the other sides of the middle portion 14*b* respectively.

The driving gear 15 has pawls 21 to engage with ratchet teeth 22 formed on the base cover 1 such that the feed reel rotates only in a predetermined direction.

On the end face of the boss 15*a* of the driving gear 15 covering the second support axis 4, formed is a stopper groove 23 which is prepared so that, when the lid cover 2 is joined to the base cover 1, a handling member can be pushed, through a window 24 of the lid cover 2, to engage with the groove 23 and one can rotate, under the engagement, the driving gear 15 to remove slackness of a film-transferring tape a, if any.

The main cylindrical body 20*a* of the feed reel 20 is allowed to engage with the core cylinder 17*a* of the core member 17, that is, virtually with the boss 15*a* of the driving gear 15*a*; the peg 14 connected to the leading edge of a film-transferring tape a fed by the feed reel 20 is connected to the take-up reel 7 by fitting its leg portions 14*a*, 14*a* into the receptive cavities 13, 13 of the reel 7; the film-transferring head 10 is pressed in the direction as indicated by the arrow in FIG. 3 and then the rotatory disc 9 carrying the film-transferring head 10 is rotated to press the central part of the tape a, rotates 360°, and returns to the original position.

In this state, the lid cover 2 is joined to the base cover 1, and then a film-transferring operation is performed. Used portion of the tape is collected by the take-up reel 7. When the film-transferring tape wound around the feed reel 20 is used up, the lid cover 2 is detached from the base cover 1; the used tape wound around the take-up reel 7 is removed, with the peg 14 attached thereto, together with the feed reel 20; and then a new film-transferring tape is charged in the same order as described above.

While the lid cover 2 is kept joined to the base cover 1, rotation of the film-transferring head 10 in the direction of taking-up of the take-up reel 7 is restricted because the rotatory disc 9 is prevented by the base cover 1 from moving in that direction.

What is claimed is:

1. A Film-transferring device housing, in a case, a feed reel and a take-up reel rotating together through a power-transmission means, wherein a film-transferring tape is fed by the feed reel; the tape is, while being moved, pressed against a film-receiving sheet by a film-transferring head projecting outside the case; and the used portion of the tape is wound around the take-up reel, characterized in that a driving gear is rotatably mounted on a second support axis prepared in the case; a dependent gear is rotatably mounted on a first support axis prepared in the case and rotates together with the driving gear through an intermediate gear; the feed reel is detachably mounted on a boss of the driving gear; and a peg connected to the leading edge of the film-transferring tape wound around the feed reel is detachably joined to the take-up reel which also acts as a boss of the dependent gear.

2. A film-transferring device as claimed in claim 1, characterized in that the peg comprises a middle portion and a pair of leg portions provided on one and the other sides of the middle portion respectively to face each other, and is detachably joined to the take-up reel by fitting the leg portions into receptive cavities prepared on the take-up reel.

3. A film-transferring device as claimed in claim 1, characterized in that a guide strip is provided concentrically with and outside of the take-up reel; the guide strip is allowed to engage with a rotatory disc which rotates 360° in the same direction that the take-up reel rotates to collect used portions of the film-transferring tape; and a film-transferring head is provided on one end of the rotatory disc.

4. A film-transferring device as claimed in claim 2, characterized in that a guide strip is provided concentrically with and outside of the take-up reel; the guide strip is allowed to engage with a rotatory disc which rotates 360° in the same direction that the take-up reel rotates to collect used portions of the film-transferring tape; and a film-transferring head is provided on one end of the rotatory disc.

* * * * *